US007128099B2

(12) United States Patent
Finzo

(10) Patent No.: US 7,128,099 B2
(45) Date of Patent: Oct. 31, 2006

(54) PUNCHING/DEFORMING TOOL FOR A STRAPPING UNIT

(75) Inventor: Flavio Finzo, Wurenlos (CH)

(73) Assignee: Orgapack GmbH, Dietikon (CH)

( * ) Notice: Subject to any disclaimer, the term of this patent is extended or adjusted under 35 U.S.C. 154(b) by 366 days.

(21) Appl. No.: 10/442,187

(22) Filed: May 21, 2003

(65) Prior Publication Data

US 2004/0007283 A1 Jan. 15, 2004

(30) Foreign Application Priority Data

May 24, 2002 (CH) ..... 0870/02

(51) Int. Cl.
*B65D 63/02* (2006.01)

(52) U.S. Cl. ..... 140/152; 24/20 EE; 140/93.2

(58) Field of Classification Search ..... 140/93.2, 140/152; 29/521; 24/20 EE
See application file for complete search history.

(56) References Cited

U.S. PATENT DOCUMENTS 1,606,331 A * 11/1926 Anderson ..... 24/20 EE
1,980,154 A * 11/1934 Coe ..... 403/283
3,327,619 A * 6/1967 Sellman ..... 100/29
3,659,318 A * 5/1972 Timmberbeil et al. .... 24/20 EE
5,029,433 A 7/1991 Werk
5,526,852 A 6/1996 Rakovski
5,694,984 A 12/1997 Cheung

FOREIGN PATENT DOCUMENTS

DE 11 02 643 B 3/1961
DE 12 25 543 B 9/1966
DE 1 905 142 A 8/1970
DE 1905145 8/1970

* cited by examiner

*Primary Examiner*—Lowell A. Larson
(74) *Attorney, Agent, or Firm*—Lowe Hauptman & Berner, LLP

(57) ABSTRACT

Using a punching tool for a strapping unit for producing an auxiliary-free connection of ends of a strapping band, the tool having a recess of different widths, in the case of which at least one section of a recess-bounding wall is provided with a rounded portion in the region of at least one change in width, on the one hand, the intention is to make a fixed closure between the band ends possible. On the other hand, the intention is for this tool to be produced as easily and cost-effectively as possible and, in addition, for uniform cutting forces to be made possible. For this purpose, it is proposed that the rounded portion is of circle-arc shape with a certain radius, and that the largest width of the recess is equal to or less than four times the radius of the wall.

10 Claims, 4 Drawing Sheets

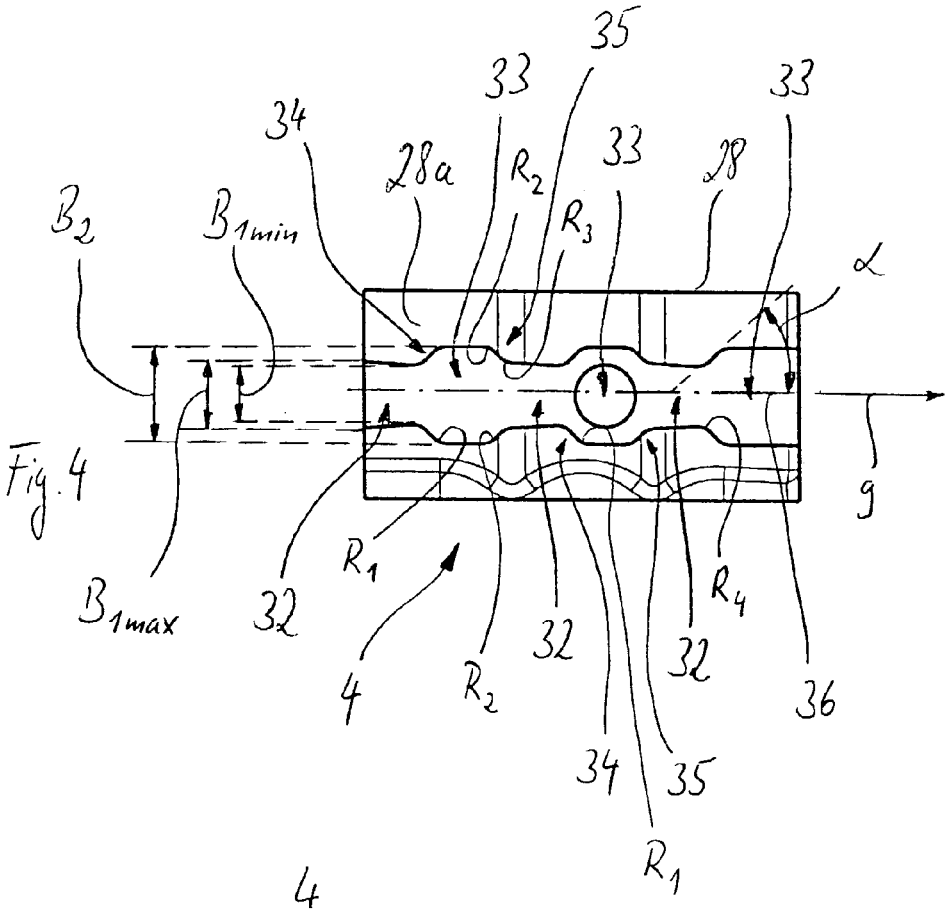
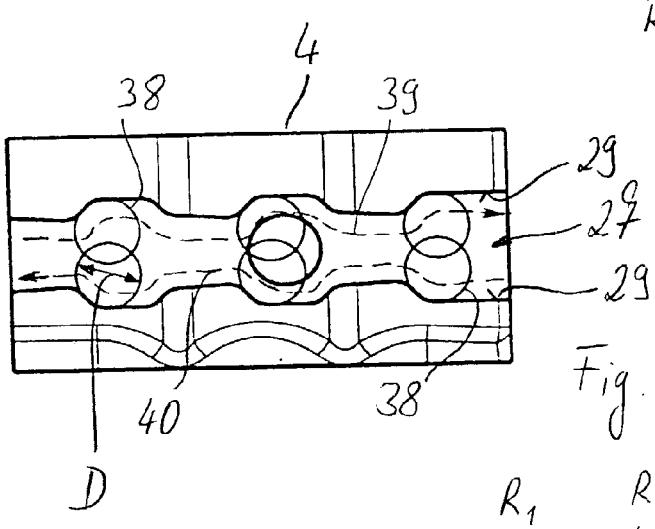
Fig. 5
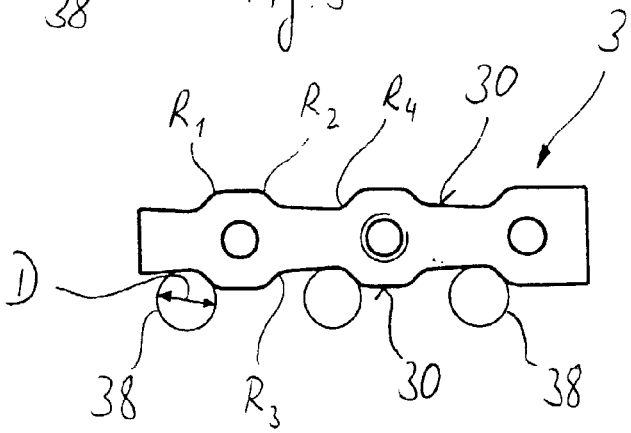
Fig. 6

PUNCHING/DEFORMING TOOL FOR A STRAPPING UNIT

The invention relates to a punching/deforming tool for a strapping unit for producing an auxiliary-free connection of ends of a strapping band, the tool having a recess of different widths, and at least one section of the recess-bounding wall being provided with a rounded portion in the region of at least one change in width. The invention additionally relates to a process for producing such a tool, and to the closure itself.

Strapping units by means of which a tensioned band loop can be positioned around articles which are to be packaged have been known for some time now. This takes place, in particular, for packaging and transporting purposes. Strapping units with very different functional principles, in particular, in relation to the connection of the two band ends, have become known in this context. The present invention relates to strapping units in the case of which the band loop is closed by deformation and the production of an incisions. A form fit is formed between the two band ends in this case. In the case of strapping units of the generic type, furthermore, the closure is produced by two interacting tools of the strapping unit. The tools are fed onto the top side of the two bands, one tool from the side of one band and the other tool from the side of the other band. The two tools, usually referred to as punch and die, force the band ends, located one upon the other, into a cavity of the die, the deformation taking place as a result.

It is known from the prior art that the recess of the die has its largest extent in the band-running direction, the width of the recess usually changing a number of times in the longitudinal direction of the recess. The die is thus of a complicated shape which is optimized in respect of the incisions which are to be achieved. It is usually sought to achieve the sharpest possible edges and corners in the wall, the intention being for these to make it possible for the two band ends to interlock to particularly good effect. It is also known, from DE-A 19 05 145, for the width to be changed by way of a radius. This is intended to reduce the risk of injury stemming from a band closure.

It has been found, however, that it is precisely the known shapes which produce a fixed and permanent closure of the band ends which are particularly difficult to produce. Up until now the recess of the die has usually been produced by impact production methods.

A further problem which may arise in the case of such tools is the frequently occurring non-uniform cutting force. Varying cutting forces during a closure operation result in an individual using the corresponding strapping unit having to apply forces of different magnitudes. However, this is regarded as disadvantageous.

The object of the invention is thus to make a fixed closure between the band ends possible, in the case of which the tools for producing the closure can be produced as easily and cost-effectively as possible and, in addition, make more uniform cutting forces possible. Nevertheless, the intention is also for the closure to have good strength properties.

This object is achieved according to the invention, in the case of an apparatus of the type mentioned in the introduction, in that the rounded portion is essentially of circle-arc shape with a certain radius, and in that the largest width of the recess is equal to or less than six times, but preferably equal to or less than four times the radius of the wall. The object is additionally achieved by a process as described in below.

As a measure according to the invention, one or more rounded portions are thus provided in the region of changes in width of the boundary wall of the recess. It has surprisingly been found, within the context of the invention, that such rounded portions contribute to a more uniform cutting force of the tool during the production of a closure between two band ends. If, in order to produce the recess, use is made of a milling process which utilizes a cylindrical milling cutter, then it is particularly easy to produce radii.

The milling process is particularly economical if, according to the invention, the at least one radius and certain dimensions of the recess are coordinated with one another. It is thus possible for the largest width of the recess to be produced, in a particularly cost-effective manner, by the same tool as the radius, provided that the largest width of the recess is no more than triple, preferably double, the diameter of the milling cutter. It is also a contributory factor to cost-effective production if the smallest width is equal to or greater than the diameter of the milling cutter and thus double the value of the radius of the recess. It is thus possible for the smallest width of the recess to be produced with, at most, two cutting paths.

In connection with the invention the term "width" is to be understood as a dimension, which is essentially parallel to the orientation of the (flat) surfaces of the band ends to be closed, and essentially orthogonal to the band-running direction. Further, with the term "rounded portion" such directions of curvature are to be understood which are also orientated essentially parallel to the (flat) surfaces of the band ends to be connected.

It has been found that the radius according to the invention of the recess and/or of the milling cutter should be selected from a range of from 1 mm to 2.5 mm, preferably from a range of from 1.3 mm to 2.0 mm.

Further preferred configurations of the invention can be gathered from the claims and the drawings.

The invention will be explained in more detail with reference to an exemplary embodiment illustrated, purely schematically, in the figures, in which:

FIG. 4 shows a plan view of the die according to the invention from FIG. 3;

FIG. 5 shows a milling cutter in a number of positions during a process for producing the die according to the invention from FIG. 4; and FIG. 6 shows a milling cutter in a number of positions during a process for producing the punch according to the invention from FIG. 3.

Figure 1:
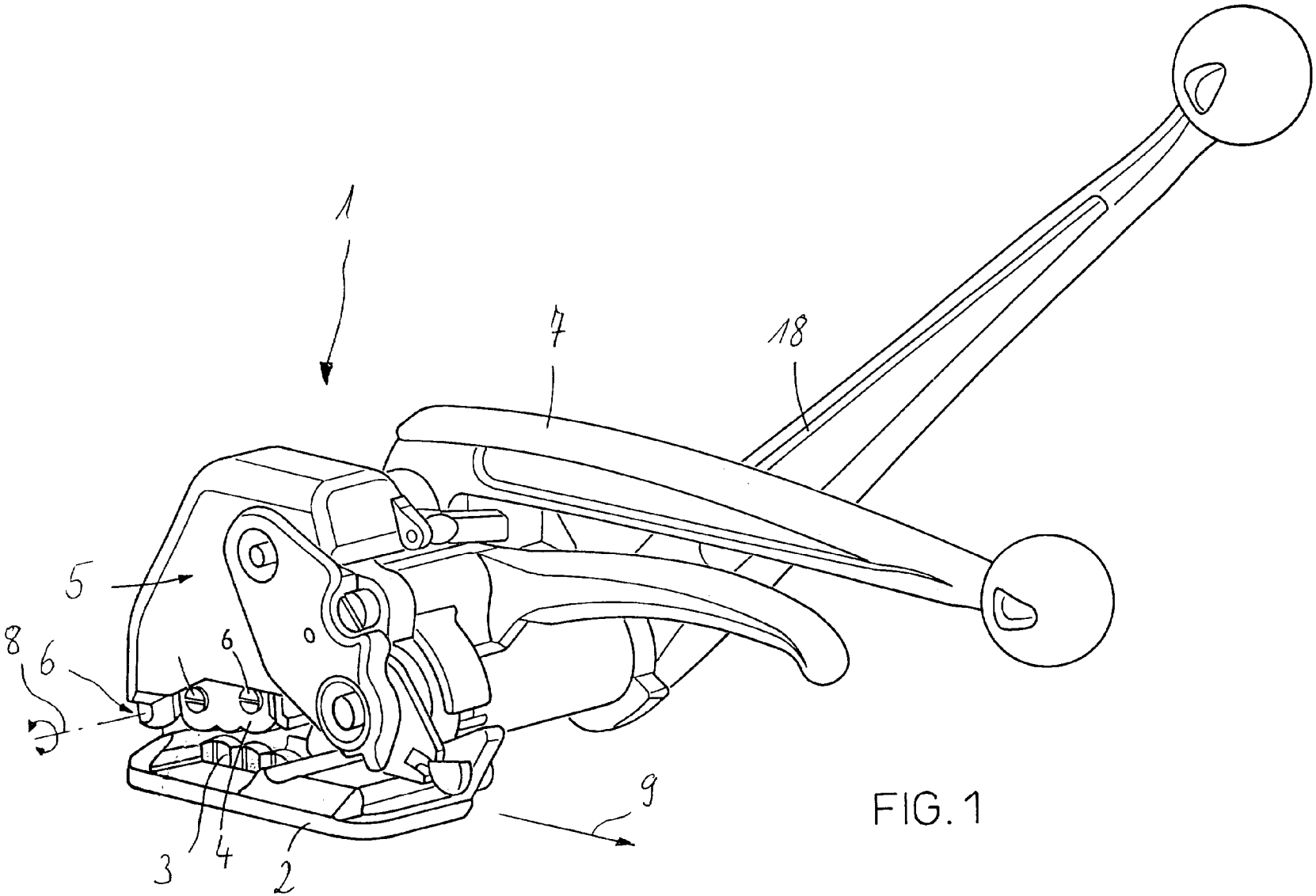
FIG. 1 shows a strapping unit of the generic type in which use is made of a tool according to the invention.

The manually actuated strapping unit 1 shown in FIG. 1 is an example of strapping units of the generic type at which the invention is directed. The strapping unit has a base plate 2, by means of the preferably planar underside of which the strapping unit is positioned on an article which is to be strapped. A single-part punch 3 is fastened in the base plate 2. A single-part die 4 which interacts with the punch 3 is fastened in a releasable manner in a die carrier 5. The die carrier 5 is articulated in a pivotable manner by means of a rotary articulation 6, which is arranged at a front end of the base plate 2 (and of which the pivot axis 8 is illustrated). By means of a pivoting lever 7, the die carrier 5 can be pivoted about the pivot axis 8 in the direction of the base plate 2 and raised off from the latter again. The pivot axis 8 here is oriented essentially orthogonally to a band-running direction 9. During production of a strapping arrangement, the two band ends 10, 11 are located one above the other in the band-running direction 9 between the base plate 2 and the die carrier 5, in order then subsequently to be connected to one another.

During lowering, the punch 3, together with the two band layers, penetrates into a recess which belongs to the die 4, and will be explained in more detail hereinbelow, this resulting in the formation of a closure 15 of two ends 10, 11 of a steel band, this closure being shown in FIG. 2. In this case, one tool part approaches the two band ends 10, 11 from above, while the other tool part is arranged in a stationary manner beneath the two band ends 10, 11. Since it is usually the case with such strapping units that the pivoting radius is relatively large in comparison with the magnitude of the stroke movement of the die, the die 4 moves at least more or less rectilinearly in the direction of the punch 3. Prior to this closure operation, a variously known tensioning mechanism of the strapping unit 1 has been actuated by means of a tensioning lever 18 (FIG. 1), as a result of which, in turn, a band loop around an article which is to be packaged has been tensioned.

Figure 2:
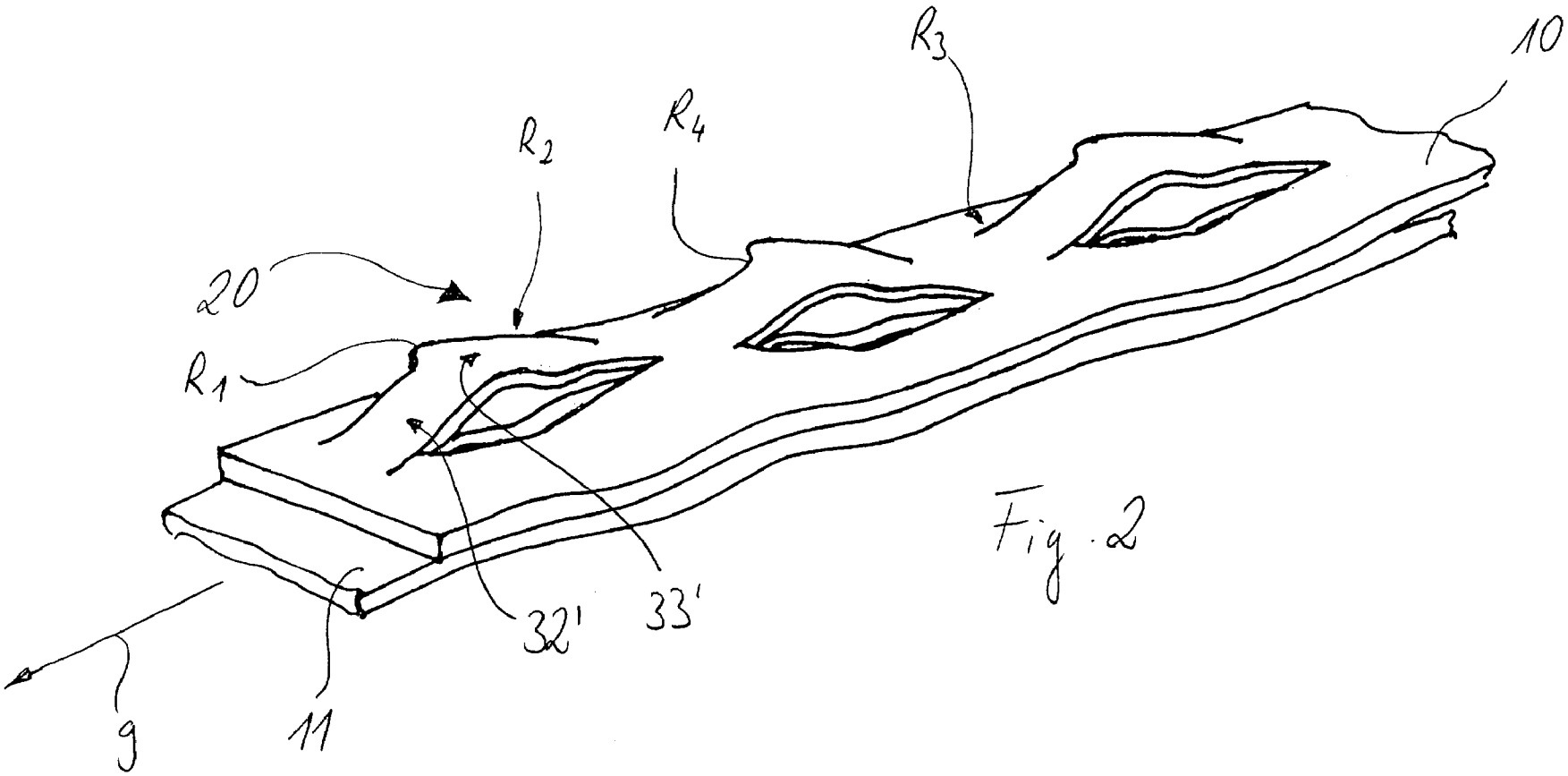
FIG. 2 shows a closure produced by a tool according to the invention.

The punch 3 and die 4 here produce, by incisions and deformation, a region 20, shown in FIG. 2, in the two band ends 10, 11 which acts as a closure of the band ends 10, 11. This results in the band ends interlocking, which is basically known per se, in particular in the band-running direction. This permanently prevents the band ends from being released in an undesired manner.

Figure 3:
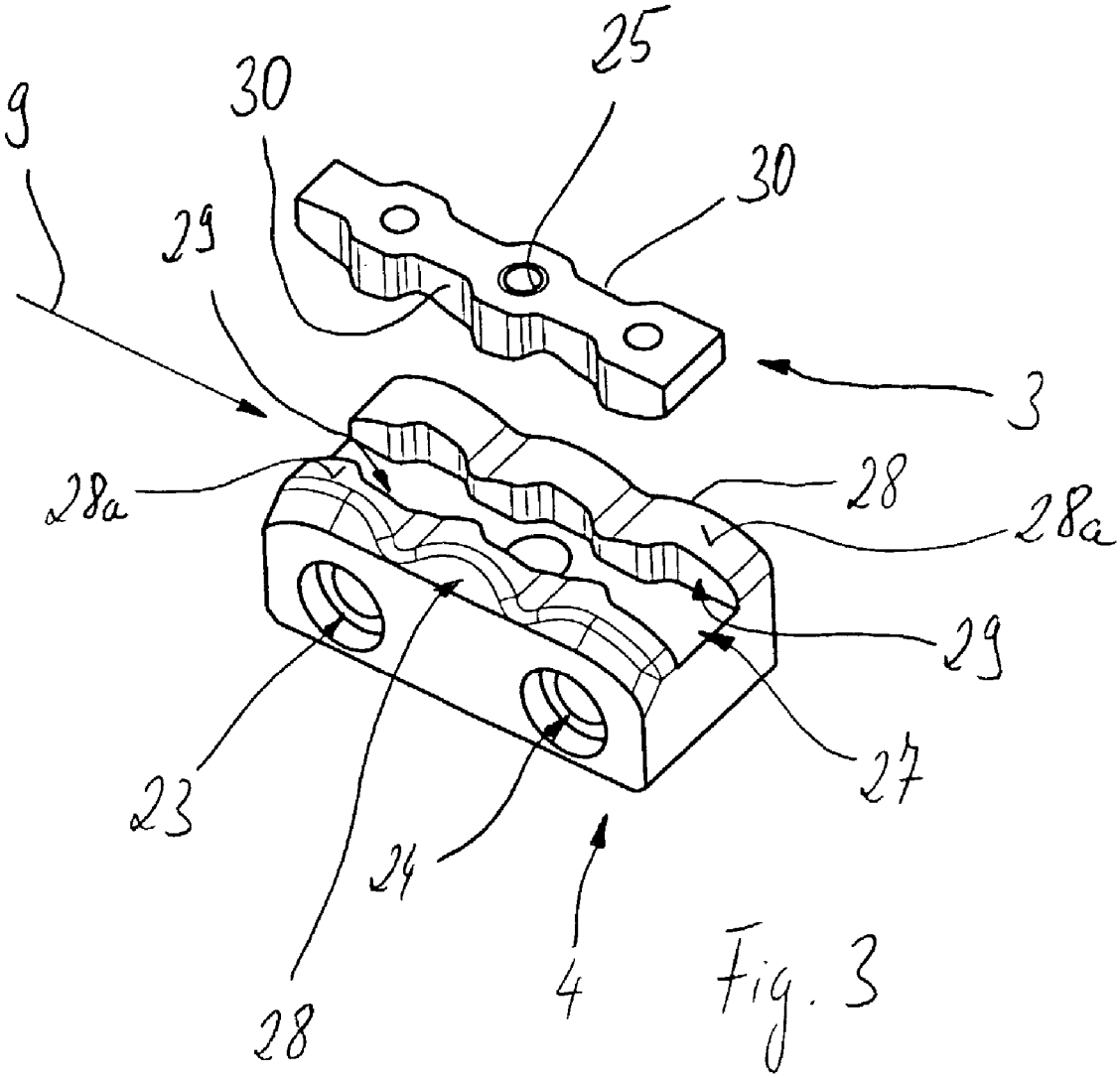
FIG. 3 shows a perspective illustration of a punch according to the invention and of a die according to the invention.

FIG. 3 shows a die 4 according to the invention and a mating punch 3 of a punching tool. Both the die and the punch have bores 23, 24, 25 which serve for fastening the two tool parts, inter alia, by means of screws 26, on the base plate 2 and the die carrier 5 of FIG. 1. The die is provided with a recess 27 which is bounded by two walls 28. The walls 28 have an undulating top side 28a in the direction of the punch 3. A wall surface 29 formed by the two walls 28 here bounds the recess 27. The contour or the profile of the wall surface 29 here corresponds to an outer contour 30 of the punch 3. The latter may thus penetrate into the recess 27 of the die 4, a small gap of essentially constant magnitude being produced here between the punch and the wall.

As can be gathered both from FIG. 3 and from FIG. 4, the die 4 is of a more or less cuboidal basic shape. The groove-like recess 27 runs over the entire length of the die 4 and is open in each case in the direction of the two end sides of the latter. The recess 27, in addition, runs parallel to the longitudinal extent of the die 4 and thus also parallel to the band-running direction 9. The recess 27 has essentially identical sections 32, 33 with two different width ranges. The exemplary embodiment of FIG. 4 provides in each case three sections 32 with a width range $B_{1min}$ equal to 3.2 mm to $B_{1max}$ equal to 3.8 mm, on the one hand, and three sections with the constant width $B_2$ of 6 mm on the other hand. A section of one width range $B_1$ is followed in each case by a section of the other width $B_2$. This periodicity is repeated three times. The sections 32, 33 are of essentially equal length in the band-running direction 9, which is also indicated in FIG. 4. The section with the smaller width range 32 tapers linearly in each case from a width $B_{1max}$ to a width $B_{1min}$.

The two regions $B_1$, $B_2$ are connected to one another by transition locations 34, 35. In contrast to the two regions 32, 33, the wall surface and/or tangents to the transition locations 34, 35 are at a relatively large angle $\alpha$ to the band-running direction or an axis of symmetry 36 of the recess, which is identical to the band-running direction. In the exemplary embodiment, the angle $\alpha$ may be 45° or more. The transition locations 34, 35 here run into the sections 33, with the larger of the two width ranges, with a radius $R_1$ of 1.55 mm and a concave circle-arc shape. A concave arc with a radius $R_2$ of 1.55 mm likewise immediately adjoins the end of the sections 33, as a constituent part of the transition location 35. The transitions to and from the sections 32 are also provided with a respective radius $R_3$, $R_4$. These constituent parts of the convex transitions 34, 35 of circle-arc shape with a radius $R_3$, $R_4$ of likewise, in each case, 1.55 mm.

As can be gathered from FIG. 3, the punch 3 is shaped congruently with the recess 27 of the die and is essentially a negative image of the recess 27. The punch 3 thus likewise has sections with two different widths, the transitions to the larger width each also being provided with the same radii.

In order to produce the die 4 according to the invention which is illustrated in FIGS. 3 and 4, use is made of an end-milling cutter 38 which cuts along its circumference and on its end side and has a radius of 1.55 mm. The milling cutter 38, which is illustrated in section in FIG. 5, may be guided along two cutting paths 39, 40, in the case of which the centre axis of the milling cutter 38 is displaced in each case parallel to the desired contour of the wall surface 29 which is to be produced. The entire wall surface 29 can be produced by means of just these two cutting paths 39, 40. A penetration depth of the milling cutter 38 here corresponds to the height of the wall surface 29. Since both the width $B_{1max}$ and $B_{1min}$ of the narrower locations of the recess, and the width $B_2$ of the wider locations are, at most, equal to double the diameter D of the milling cutter 38, it is also possible for the entire recess 27 to be produced by means of these two cutting paths alone.

In a further embodiment according to the invention, which is not illustrated, it is also possible for the largest width of the larger-width section to be more than double the diameter of the milling cutter. The largest width, however, should correspond to not more than three times the diameter of the milling cutter 38 and thus six times the radius $R_1$. In this case, it is possible for the material which still remains in the recess to be removed in the band-running direction by way of a third cutting path. The third cutting path may lead through the already produced sections with a smaller width range than non-productive cuts.

According to FIG. 6, the punch may be produced from a cuboidal block, in the case of which the two longitudinal sides 30 of the punch are to be produced by means of the same milling cutter 38.

It can be gathered from FIG. 2 that a closure produced by a punching tool according to the invention has a deformed region 20 provided with punched incisions. This region 20 contains in the band ends 10, 11, sub-regions 32', 33' which are essentially an image of the sections 32, 33 of the punching tool. This means that it is also the case that the closure, on the one hand, contains, on its punched/deformed outer edges, radii $R_1'$–$R_4'$ which essentially correspond to the radii $R_1$–$R_4$.

On the other hand, the deformed/punched sub-regions 32', 33' also have widths $B_{1min}'$, $B_{1max}'$ and $B_2'$ which have at least more or less the same values as the respectively corresponding widths $B_{1min}$, $B_{1max}$ and $B_2$ of the tool.

The invention claimed is:

1. A punching tool for a strapping unit for connecting ends of a strapping band, comprising:

a recess having shaped opposed walls which shaped walls extend along either side of the recess in a band running direction, the shaped walls being configured to define a plurality of alternating wide and narrow portions along the recess, the shaped opposed walls being configured such that each transition between a wide portion and a narrow portion in each side wall is curved and has a radius having a predetermined relationship with a width of the recess wherein a largest width of a wide portion is equal to or less than six times said radius.

2. A punching tool as set forth in claim 1, wherein the plurality of alternating wide and narrow portions comprises three wide portions and three narrow portions.

3. A punching tool as set forth in claim 1, wherein the largest width of a wide portion is equal to or less than four times said radius.

4. A punching tool as set forth in claim 1, wherein a narrowest width of a narrow portion is at least double said radius.

5. A punching tool as set forth in claim 1, wherein said radius is selected to be in a range of 1.0 mm to 2.5 mm.

6. A punching tool as set forth in claim 1, wherein the recess is formed using a cylindrical milling element having a diameter which has a predetermined relationship with said radius.

7. A process for producing a die of a strapping unit by means of which it is possible to produce a closure between ends of a strapping band which runs in a predetermined direction, comprising:

rotating a cylindrical milling element having a predetermined diameter about an axis which is normal to the band running direction, and milling, using the cylindrical milling element, a recess having a recess having shaped opposed walls which shaped walls extend along either side of the recess in the band running direction, the shaped walls being milled to define a plurality of alternating wide and narrow portions along the recess, the shaped opposed walls being configured such that each transition between a wide portion and a narrow portion in each side wall is milled have a curve having a radius that has a predetermined relationship with a width of the recess which is milled, wherein a largest width of a wide portion is equal to or less than six time said radius, and wherein said radius has a predetermined relationship with said predetermined diameter.

8. A process as set forth in claim 7, wherein a smallest width of a narrow portion taken normally to the running direction is at least double said radius.

9. A closure of two band ends of a band strapping arrangement, the closure being produced by means of a punch and a die of a strapping unit by way of a punching/deforming operation and such that each punched/deformed region of each of the two band ends comprises:

an elongate vertically deformed portion, and two elongate side portions which extend along on either side of the vertically deformed portion, each of the vertically deformed portions having a plurality of alternating wide and narrow portions along its length, and wherein a narrowest width of each narrow portion is at least double a corresponding width of each side portion.

10. A closure as set forth in claim 9, wherein the closure is auxiliary free.

* * * * *